US009401585B2

(12) United States Patent
Achtstätter et al.

(10) Patent No.: US 9,401,585 B2
(45) Date of Patent: Jul. 26, 2016

(54) CORONA IGNITION DEVICE

(71) Applicant: BorgWarner Ludwigsburg GmbH, Ludwigsburg (DE)

(72) Inventors: Tom Achtstätter, Hemmingen (DE); Volker Dezius, Affalterbach (DE); Johannes Hasenkamp, Ludwigsburg (DE); Heiko Schrader, Kleinbottwar (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 0 days.

(21) Appl. No.: 14/613,721

(22) Filed: Feb. 4, 2015

(65) Prior Publication Data

US 2015/0236481 A1 Aug. 20, 2015

(30) Foreign Application Priority Data

Feb. 17, 2014 (DE) ..... 10 2014 101 967

(51) Int. Cl.
*H01T 13/00* (2006.01)
*H01T 13/04* (2006.01)
*H01T 13/20* (2006.01)

(52) U.S. Cl.
CPC ..... *H01T 13/04* (2013.01); *H01T 13/20* (2013.01)

(58) Field of Classification Search
CPC ..... H01T 13/00; H01T 13/04; H01T 13/08; H01T 13/20; H01T 19/00; H01T 19/02
USPC ..... 313/118, 142, 143
See application file for complete search history.

(56) References Cited

U.S. PATENT DOCUMENTS 5,749,742 A * 5/1998 Bertuzzi, Jr. ..... H01R 13/6276 439/125
6,467,447 B1 * 10/2002 Holmes ..... F02P 13/00 123/169 PA
8,767,372 B2 7/2014 Stifel et al.
2006/0148338 A1 * 7/2006 Virchow ..... H01R 24/20 439/851
2010/0175653 A1 * 7/2010 Lykowski ..... H01T 13/04 123/143 C
2013/0155570 A1 * 6/2013 Stifel ..... H01T 13/44 361/263
2013/0199484 A1 * 8/2013 Stifel ..... F02P 23/04 123/143 B
2014/0137845 A1 * 5/2014 Achtstatter ..... H01T 13/34 123/634

FOREIGN PATENT DOCUMENTS

DE 10 2010 055 570 B3 3/2012
DE 10 2010 051 371 A1 5/2012
DE 10 2010 062 276 A1 6/2012

* cited by examiner

*Primary Examiner* — Donald Raleigh
*Assistant Examiner* — Kevin Quarterman
(74) *Attorney, Agent, or Firm* — Bose McKinney & Evans LLP

(57) ABSTRACT

A corona ignition device for igniting fuel in an internal combustion engine by means of a corona discharge. The corona ignition device comprises a central electrode, an insulator into which the central electrode is plugged, a housing into which the insulator is plugged, a coil body onto which a coil from a winding wire is wound, which coil is connected to the central electrode, and a contact element that is located in a recess of the coil body and contacts the wire. It is provided that the contact element has a slot that runs in the longitudinal direction of the coil body, and the coil body has an opening in a side wall of the recess, wherein the wire is fed through the opening in the side wall of the recess and is held in the slot of the contact element.

10 Claims, 4 Drawing Sheets

CORONA IGNITION DEVICE

RELATED APPLICATIONS

This application claims priority to DE 10 2014 101 967.1, filed Feb. 17, 2014, the entire disclosure of which is hereby incorporated herein by reference in its entirety.

BACKGROUND

The invention relates to corona ignition device. Corona ignition devices are generally known from DE 10 2010 055 570 B3.

During the operation of corona ignition devices it was found that the dielectric strength is a problem. Voltage flashovers and partial discharges in such known corona ignition devices often result in premature failure. Particularly critical are the coil end on the combustion chamber side and the electrical connection thereof to the central electrode. The installation space available for the central electrode for contacting the coil is very limited. Moreover, no edges or projections should be created by the contacting because they result in local field peaks and thus reduce the dielectric strength.

SUMMARY

The present invention provides an improvement for electrically contacting the coil of a corona ignition device.

In the case of a corona device according to this disclosure, the coil is contacted via a contact element that is located in a recess of the coil body. The contact element has a slot which runs in the longitudinal direction of the coil body and in which the wire of the coil is held, which wire is fed through an opening in a side wall of the recess of the coil body. The opening in the side wall of the recess of the coil body is preferably a slot.

Local field peaks due to bumps as they can occur during soldering or welding can be avoided with a corona device according to this disclosure. For example, the contact element can be fabricated from sheet metal in a cost-effective manner and can be inserted into the recess of the coil body. The slot of the contact element can reliably hold and contact the winding wire, for example as an insulation displacement connection.

An advantageous refinement of this disclosure provides that the slot narrows in a wedge-like manner. In this way, the wire of the coil can be clamped particularly well in the slot and can be retained therein. The slot is preferably open at its wide end.

The slot can narrow in the direction towards the coil body. In this case it is beneficial to insert the contact element first into the recess of the coil body and to subsequently feed the winding wire through the opening in the side wall of the recess of the coil body and to clamp it in the slot. However, it is also possible that the slot narrows in the direction away from the coil body. In this case, the winding wire is usually first fed through the opening into the recess of the coil body and subsequently, the contact element is inserted into the recess.

Another advantageous refinement provides that the slot widens at its open end in a step-like manner. By such a step, an edge can be created that scrapes off the insulation of the winding wire when feeding in the same. A section of the slot which narrows in a wedge-like manner towards the closed end of the slot can be connected to the step. The inner and outer edges of the step can be arranged at different heights so that a cutting edge is created. In other words, the joint surface of the two edges does not run perpendicular but rather diagonal to the surface in which the slot is located. A cutting edge makes scraping off insulation of the winding wire easier.

Another advantageous refinement of this disclosure provides that the slot narrows perpendicular to its longitudinal direction. The slot can narrow inwardly or outwardly. If the slot narrows inwardly, the two edges which delimit the slot on the inside of the contact element are closer together than the two edges which delimit the slot on the outside of the contact element. If the slot narrows outwardly, the two edges which delimit the slot on the inside of the contact element are farther apart than the two edges which delimit the slot on the outside of the contact element. By the slot narrowing perpendicular to its longitudinal direction, an improved insulation displacement effect can be achieved.

A simple possibility to produce a contact element the slot of which narrows perpendicular to its longitudinal direction is to twist legs or walls on both sides of the slot about a geometrical axis that runs in the direction of the slot. In this manner it can be achieved that either the two inner edges of the slot are moved towards one another and the two outer edges of the slot are moved away from one another or vice versa.

Another advantageous refinement of this disclosure provides that the contact element has opposing slots in which the winding wire is held. In this manner, contacting can be improved. In this case, the winding wire can be clamped in two slots. For example, two insulation displacement contacts can be provided between winding wire and the contact element, which advantageously reduces the contact resistance.

With the described contact element, the coil can be connected to the central electrode in a particularly advantageous manner by plugging a section of the central electrode into the recess of the coil body, for example. Alternatively or additionally, the coil with the described contact element can also be contacted on its side remote from the combustion chamber by inserting a contact pin of a power connector of the corona ignition device into a recess at the coil body's end remote from the combustion chamber.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

In this disclosure, terms such as "vertical," "perpendicular," "horizontal," "longitudinal," "central," "rectangular" and the like are used to describe the orientation, position or general shape of structural elements disclosed herein. As would be readily recognized by one of ordinary skill, it shall be understood for purposes of this disclosure and claims that these terms are not used to connote exact mathematical orientations or geometries, unless explicitly stated, but are instead used as terms of approximation. With this understanding, the term "vertical," for example, certainly includes a structure that is positioned exactly 90 degrees from horizontal, but should generally be understood as meaning positioned up and down rather than side to side. Other terms used herein to connote orientation, position or shape should be similarly interpreted. Further, it should be understood that various structural terms used throughout this disclosure and claims should not receive a singular interpretation unless it is made explicit herein. By way of non-limiting example, the terms "electrode," "contact element," "slot," to name just a few, should be interpreted when appearing in this disclosure and claims to mean one or more. All other terms used herein should be similarly interpreted unless it is made explicit that a singular interpretation is intended.

Figure 1:
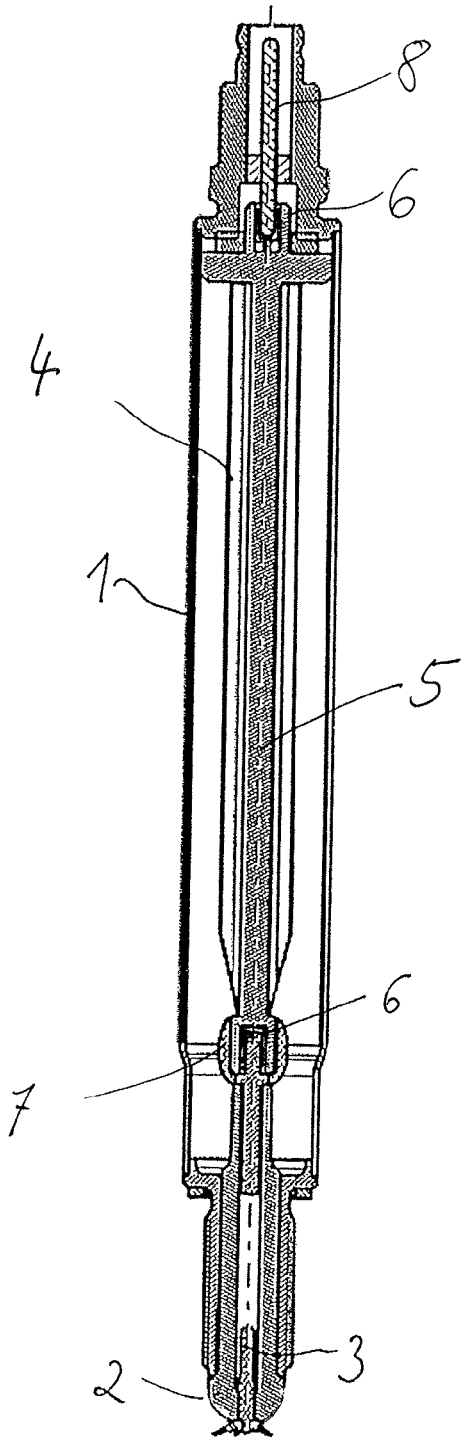
FIG. 1 shows a schematic illustration of a corona ignition device.

The corona ignition device schematically illustrated in FIG. 1 generates a corona discharge for igniting fuel in a combustion chamber of an engine. The corona ignition device has a housing 1 that is closed at a front end by an insulator 2. A central electrode 3 which has one or more ignition tips protrudes out of the front end of the insulator 2. The central electrode 3, the insulator 2 and the housing 1 together form a capacitance that is connected in series with a coil 4 connected to the central electrode 3. The coil 4 consists of a wire that is wound onto a coil body 5.

This capacitance and the coil 4 are part of an electrical oscillating circuit, by the excitement of which corona discharges can be generated at the ignition tips or the ignition tip of the central electrode 3.

One section of the central electrode 3 can be formed from electrically conductive glass that seals the channel passing through the insulator 2. For this purpose, melted glass that was rendered electrically conductive by admixing metal or carbon particles is made to solidify in the channel of the insulator 2. A rear section of the central electrode 3 is inserted in a recess of the coil body 5. In this recess of the coil body 5 there is a contact element 6 via which the winding wire is connected to the central electrode 3. The end section of the coil body 5 in which the contact element 6 is located is inserted in a shield cap 7. An illustrative embodiment of this contact element 6 is illustrated in FIG. 2.

At its end remote from the combustion chamber, the coil body 5 has another recess in which a contact element 6 is arranged via which the winding wire is connected to a connection contact, for example to a contact pin 8. The contact pin 8 can be part of a plug connector by means of which the corona ignition device is connected to a voltage source.

Figure 2:
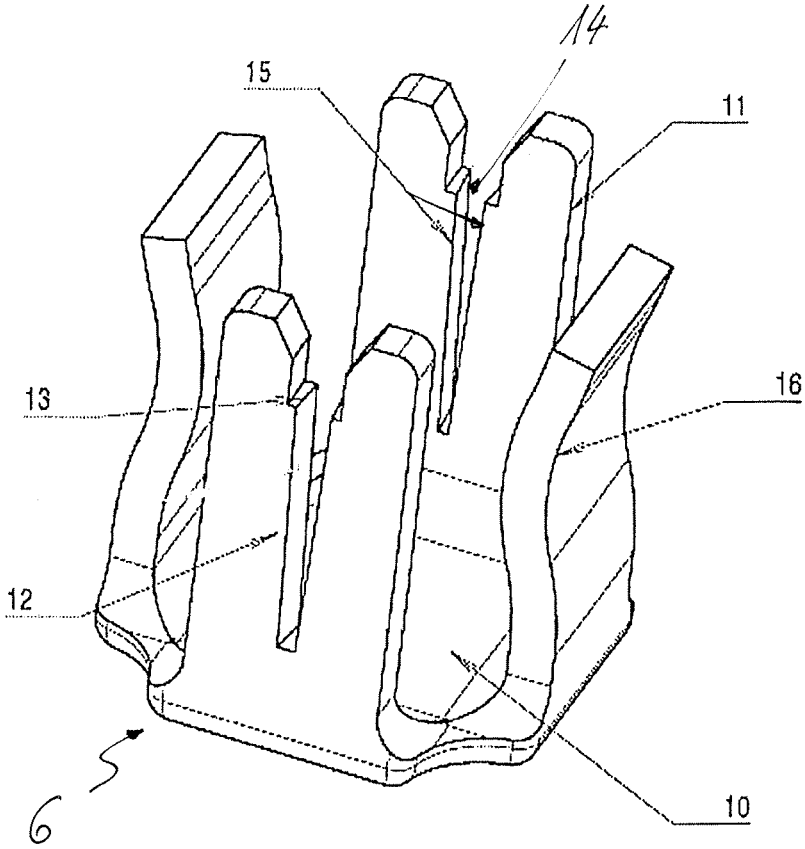
FIG. 2 shows an illustrative embodiment of a contact element.

The contact element 6 arranged in a front-side recess of the coil body 5 is illustrated in FIG. 2. The contact element 6 has two opposing slots 12 in which the winding wire of the coil 4 is clamped. The contact element 6 and the winding wire form an insulation displacement connection. The winding wire is fed through an opening in a side wall of the recess of the coil body 5. This opening can be a slot, for example.

The contact element 6 can have spring clips 16 which press against the coil body 5 in the recess of the coil body 5 and thereby hold the contact element 6 in the recess of the coil body 5.

In the illustrative embodiment shown, the slots 12 are arranged in the legs 11 which are not deformed when inserting the contact element 6 into the recess of the coil body or when plugging in the central electrode 3 or the contact pin, but instead the spring clips 16 are deformed. In this manner it can be reliably avoided that the contacting of the winding wire is affected. However, it also possible to arrange the slots 12 in spring clips.

The slots 12 are open on one end and widen over a major portion of their length in a wedge-shaped manner towards their open end. In this manner, the clamping effect is increased. At their open end, the slots can widen with a step 13. In this manner it is easier to remove insulation, for example a lacquer layer, of the winding wire when inserting the winding wire into the slot 12. The step 13 can be formed to be inclined in that its inner and outer edges are located at different heights. In this manner, a cutting edge can be created that scrapes off an insulation layer when inserting the winding wire.

The slots 12 can narrow perpendicular to their longitudinal direction. This case applies to the rear one of the two slots 12 in FIG. 2. The two inner edges 15, which delimit the slot 12, are closer together than the two outer edges 14. If the slot 12 narrows inwardly or outwardly perpendicular to its longitudinal direction, the insulation displacement connection between the contact element 6 and the winding wire 9 clamped in the slot 12 can be improved.

Figure 3:
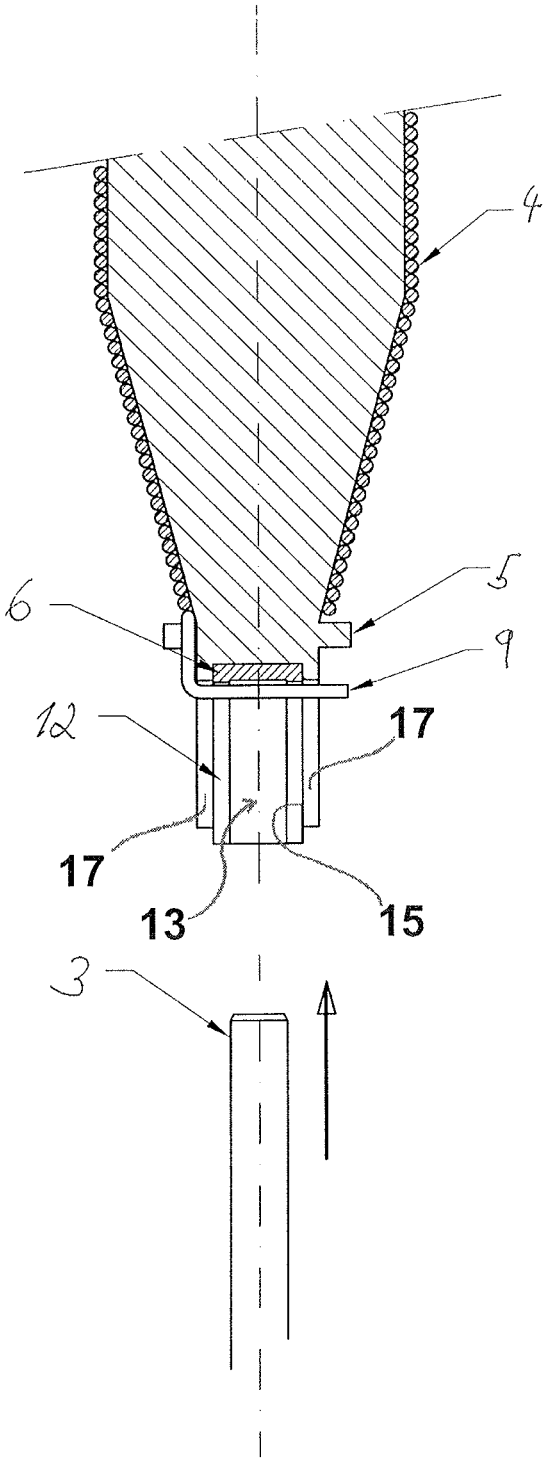
FIG. 3 shows a schematic detailed view of another illustrative embodiment.

FIG. 3 shows schematically how the coil 4 of a corona ignition device can be connected to the central electrode 3 or a contact pin 8. The coil 4 from winding wire 9 is wound onto a coil body 5 that has a recess 13 on its front end. In FIG. 3, the recess 13 is defined by cylindrical wall 15 of the coil body 5. A contact element 6 that can be shaped according to FIG. 2 is located in this recess. As an alternative, the contact element 6 can also be shaped as a cylindrical sleeve.

The contact element 6 has two opposing slots in which the winding wire is held. For this purpose, the coil body 5 has an opening in a side wall of the recess through which the winding wire 9 is fed. In the embodiment shown, the coil body 5 has an opening, for example slots 17, on opposing places of the side wall as shown in FIG. 3, in which opening the winding wire 9 is plugged.

In order to electrically connect the winding wire 9 to the central electrode 3 or a contact pin 8, the central electrode is plugged into the recess and the contact element 6. The winding wire 9 can be slid deeper into the slot or slots of the contact element 6. As a result, the insulation displacement connection between the winding wire 9 and the contact element 6 can be further improved.

Figure 4:
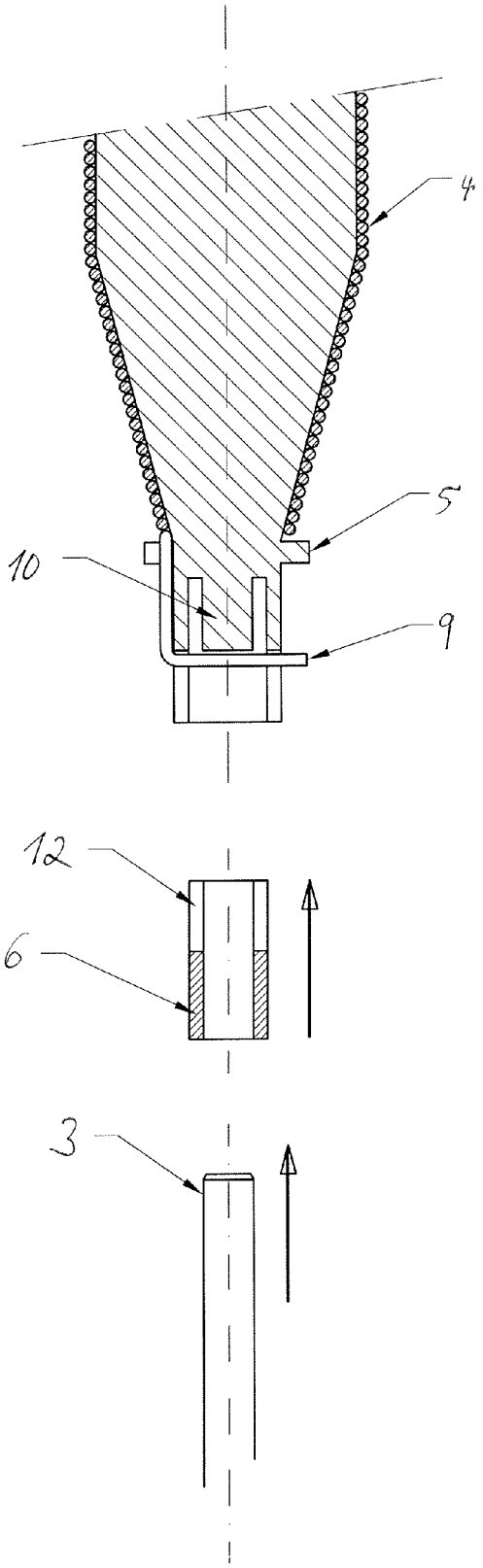
FIG. 4 shows a schematic detailed view of a further illustrative embodiment.

FIG. 4 shows in a schematic illustration of another possibility on how the coil 4 of a corona ignition device can be connected to the central electrode 3 or a contact pin 8. As in the above-described embodiment, the coil 4 is wound from a wire 9 onto a coil body 5 which has a recess in a front end thereof. The wire 9 is slid through an opening in a side wall of the recess of the coil body 5. As in the above-described embodiment, the coil body 5 can have opposing openings for the wire 9.

The wire 9 is contacted with a contact element 6 that is inserted into the recess of the coil body 5. In the embodiment shown, the contact element 6 is a cylindrical sleeve which has opposing slots for clamping the coil wire 9. However, instead of a circular footprint, the contact element 6 can also have a rectangular footprint, as illustrated in FIG. 2. The essential difference to the embodiment of FIG. 3 is that the contact element 6 is inserted with reversed orientation into the recess of the coil body 5.

In the embodiment of FIG. 3, the contact element 6 has a bottom that faces towards the coil 4. The free ends of the legs 11 therefore face away from the coil. The contact element 6 can also be formed without a bottom, for example tubular.

In contrast, in the embodiment of FIG. 4, the free ends of the legs 11 face towards the coil 4. When plugging the contact element 6 into the recess of the coil body 5, the winding wire 9 is clamped in the slots of the contact element 6. In order to improve the fit of the contact element 6 in the recess of the coil body 5, a counter holder 10 can be arranged in the recess, which counter holder engages in the interior of the contact element 6. For example, the counter holder 10 can push spring clips of the contact element 6 against side walls of the recess of the coil body 5. The central electrode 3 is plugged into the other end of the contact element 6. Legs or clips of the contact element 6 then provide for good electrical contact between the contact element and the central electrode 3.

However, a counter holder 10 can also be dispensed with, for example by keeping the contact element 6 open on both sides so that the central electrode 3 or a contact pin 8 can be plugged into the contact element 6 from both directions.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

REFERENCE LIST

1 housing
2 insulator
3 central electrode
4 coil
5 coil body
6 contact element
7 shield cap
8 contact pin
9 wire
10 counter holder
11 leg of the contact element 6
12 slots of the contact element 6
13 step
14 outer edge of the slot 12
15 inner edge of the slot 12
16 spring clip

What is claimed is:

1. A corona ignition device for igniting fuel in an internal combustion engine by means of a corona discharge, the corona ignition device comprising:

a central electrode;

an insulator surrounding the central electrode;

a housing holding the insulator;

a coil body onto which a coil made of a wire is wound, the coil being connected to the central electrode, the coil body having a recess with an opening located in a side wall of the recess; and a contact element located in the recess and contacting the wire, the contact element having a slot extending in the longitudinal direction of the coil body, wherein the wire passes through the opening in the side wall of the recess and is held in the slot of the contact element.

2. The corona ignition device according to claim 1, wherein the slot of the contact element is open at one end and widens towards the open end.

3. The corona ignition device according to claim 1, wherein the slot of the contact element narrows in a direction perpendicular to its longitudinal direction.

4. The corona ignition device according to claim 1, wherein the slot of the contact element effects an insulation displacement connection between the contact element and the wire.

5. The corona ignition device according to claim 1, wherein the slot of the contact element includes a step that widens the slot.

6. The corona ignition device according to claim 1, wherein the contact element has two opposing slots in which the wire is held.

7. The corona ignition device according to claim 1, wherein the contact element has spring clips which press in the recess against the coil body.

8. The corona ignition device according to claim 1, wherein the central electrode is plugged in the recess of the coil body.

9. The corona ignition device according to claim 8, wherein the contact element has an opening through which the central electrode protrudes.

10. The corona ignition device according to claim 1, wherein the contact element connects a contact protruding out of the housing to the coil.

* * * * *